US007793407B2

(12) United States Patent
Ahn

(10) Patent No.: US 7,793,407 B2
(45) Date of Patent: Sep. 14, 2010

(54) APPARATUS FOR ENCLOSING EXPOSURE WIRE PARTS OF SPRING ASSEMBLY FOR BED MATTRESS

(75) Inventor: Sung Ho Ahn, Kyonggi-Do (KR)

(73) Assignee: Ace Bed Co., Ltd., Kyonggi-Do (KR)

( * ) Notice: Subject to any disclaimer, the term of this patent is extended or adjusted under 35 U.S.C. 154(b) by 1132 days.

(21) Appl. No.: 11/431,392

(22) Filed: May 9, 2006

(65) Prior Publication Data

US 2007/0022532 A1 Feb. 1, 2007

(30) Foreign Application Priority Data

Jun. 29, 2005 (KR) ..... 10-2005-0056659
Sep. 1, 2005 (KR) ..... 10-2005-0081069

(51) Int. Cl.
*B23P 21/00* (2006.01)
*A47C 21/08* (2006.01)

(52) U.S. Cl. ..... 29/714; 5/430

(58) Field of Classification Search ..... 29/714, 29/700; 5/430, 721, 716, 235, 230, 258, 5/253, 720; 267/94
See application file for complete search history.

(56) References Cited

U.S. PATENT DOCUMENTS 6,128,798 A * 10/2000 Barman et al. ..... 5/716
6,490,744 B1 * 12/2002 Schulz, Jr. ..... 5/720
7,418,753 B2 * 9/2008 Kuchel et al. ..... 5/716

FOREIGN PATENT DOCUMENTS

KR 100444347 B1 8/2004

* cited by examiner

*Primary Examiner*—John C Hong
(74) *Attorney, Agent, or Firm*—Edwards Angell Palmer & Dodge LLP; Peter F. Corless; Kongsik Kim

(57) ABSTRACT

Disclosed herein is an apparatus for enclosing the exposure wire parts of a spring assembly for a bed mattress which can automate the work process according to the enclosure of the exposure wire parts of a spring assembly, thereby maximizing convenience of the enclosing process and work productivity. According to the inventive apparatus for enclosing exposure wire parts 115*a* of coil springs 115 in a spring assembly 100 for a bed mattress, the enclosing work of the exposure wire parts protrudingly formed in the spring assembly is performed automatically so that various work loads and the number of work processes according to the enclosing work can be minimized to thereby maximize the work productivity as well as the relevant cost according to the enclosing work is reduced, thereby saving the production cost of the mattress and improving the product competitiveness of the mattress.

8 Claims, 7 Drawing Sheets

APPARATUS FOR ENCLOSING EXPOSURE WIRE PARTS OF SPRING ASSEMBLY FOR BED MATTRESS

BACKGROUND OF THE INVENTION

1. Field of the Invention

The present invention relates to an apparatus for enclosing the exposure wire parts of coil springs protruding vertically from either an upper surface or a lower surface of a spring assembly for a bed mattress, and more particularly to an apparatus for enclosing the exposure wire parts of coil springs in a spring assembly for a bed mattress which can automate the work process according to the enclosure of the exposure wire parts, thereby maximizing work productivity.

2. Background of the Related Art

In general, a spring assembly is adapted to provide a cushion force and a buffer force through coil springs and a padding member disposed laminatedly at an upper surface or a lower surface of the coil springs. There has been proposed a protrusion-type spring assembly (hereinafter, referred to as "spring assembly") in which at least one of the upper wire part and the lower wire part of the coil spring is vertically protrudingly disposed.

For example, as shown in FIG. 1, a spring assembly 100 includes a set of springs 110 in which coil springs 115 are arranged along row and column directions (R/C); upper and lower edge members 120 and 120' positioned at upper and lower portions of the spring set 110, for supporting the outermost coil springs 115; and helical coil 130 engaged with the coil springs in a screw-engagement manner in the row direction of the spring set 110, for fixing corresponding wires of adjacent coil springs 115.

The coil springs 115 are vertically arranged spaced apart from one another at regular intervals between the upper and lower edge members 120 and 120' in such a fashion as to be securely fixed at upper and lower wire parts thereof to the upper and lower edge members 120 and 120' by means of pin members 140, respectively. Also, the coil springs 115 is formed at the upper or lower end of its housing with exposure wire parts 115*a* exposed upwardly or downwardly from the upper or lower edge member 120 or 120', respectively.

Accordingly, in the case where the spring assembly 100 is embedded in a mattress (not shown) and respective padding members are stacked on the spring assembly, resilient forces of both the coil spring 115 itself and the exposure wire parts 115*a* are doubly exerted so as to enhance a cushion force and a buffer force, thereby improving comfort to users of the mattress.

However, the spring assembly 100 has a shortcoming in that since the exposure wire parts 115*a* protrude upwardly from the upper edge member 120 with respect to a horizontal plane of the spring set 110, the padding member stacked on the upper surface of the spring set 110 undesirably comes into contact with the exposure wire parts 115*a* while causing a damage thereto, which results in shortening the lifespan of the mattress.

In addition, the spring assembly 100 embraces demerits in that when a lateral load is applied to the exposure wire parts 115*a* to cause the exposure wire parts to lean to one direction, the resilient force of the coil springs is apt to be deteriorated, and in that when the leaning portion of the exposure wire part 115*a* comes into close contact with the upper or lower edge member 120 or 120' or a wire part of the coil spring 115, a frictional noise may occur.

Accordingly, a technology for reducing a contact noise of the coil springs 115 has been proposed in the US. However, such a technology is merely intended to insert a pad, etc., between wire parts of the coil springs to prevent the friction noise rather than to enclose the exposure wire parts 115a. This technology still has problems in that when the leaning portion of the exposure wire part 115*a* comes into close contact with the upper or lower edge member 120 or 120' or a wire part of the coil spring 115, a frictional noise may occur, and in that a dual cushion function is not sufficiently provided for a user.

In order to address and solve the above-mentioned problems, there has been proposed "an apparatus for sealing the exposure wire parts of coil springs of a spring assembly for a bed mattress" (Korean patent registration No. 444347, U.S. Pat. No. 6,983,503) by the present applicant. However, this registered patent is configured such that the exposure wire parts 115*a* are sealed by using a mold foam, a non-woven fabric, or the like. Therefore, the present applicant has developed an apparatus for automatically enclosing the exposure wire parts of the coil springs and has filed a patent for the apparatus.

SUMMARY OF THE INVENTION

Accordingly, the present invention has been made in view of the aforementioned problems occurring in the prior art, and it is an object of the present invention to provide an apparatus for enclosing the exposure wire parts of coil springs in a spring assembly for a bed mattress which can automate the work process according to the enclosure of the exposure wire parts of coil springs in a spring assembly, thereby maximizing convenience of the enclosing process and work productivity.

To accomplish the above object, according to one aspect of the present invention, there is provided an apparatus for enclosing exposure wire parts of coil springs in a spring assembly for a bed mattress, the exposure wire parts protruding vertically from either an upper edge member or a lower edge member of the spring assembly in such a fashion that at least one of an upper end wire part and a lower end wire part of each of the coil springs protrudes vertically from either the upper edge member or the lower edge member, wherein the coil springs are arranged spaced apart from one another at regular intervals along row and column directions (R/C) between the upper and lower edge members in the spring assembly, the apparatus including: a body on which the spring assembly is loaded and a vertical prop and a fixing stand are mounted in such a fashion as to be spaced apart from each other by a certain interval; a reel unit mounted at an upper portion of the vertical prop for winding a non-woven fabric therearound; a traction unit for pulling and hauling the non-woven fabric wound around the reel unit, by a predetermined length upon the operation of a cylinder; an elevator unit disposed between the vertical prop and the fixing stand for vertically pulling the non-woven fabric by a length sufficient to be inserted into the exposure wire parts of the coil springs upon the operation of a cylinder; a front insertion unit mounted at the fixing stand for pushing the non-woven fabric toward the exposure wire parts in a transverse direction of the exposure wire parts while rotating by means of cylinders; a side insertion unit mounted at the body for pushing the non-woven fabric toward both sides of the exposure wire parts while moving back and forth by means of a cylinder; an adhesive unit mounted at a side portion of the front insertion unit for fixing the non-woven fabric inserted into the exposure wire parts while ascending and descending by means of a cylinder; a feeder unit mounted on the body for horizontally moving the spring assembly by one step while moving back and forth by means of a cylinder; a cutter unit mounted on the body in such a fashion as to be positioned in a feed path of the spring assembly for cutting the non-woven fabric while ascending and descending by means of a cylinder; a support unit mounted below the front insertion unit for setting the height of the exposure wire parts while ascending and descending by means of a cylinder; and a controller C for receiving a signal indicating that the spring assembly is loaded on the body to generate an operating signal in response to the received signal for sequential application to the respective cylinders.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
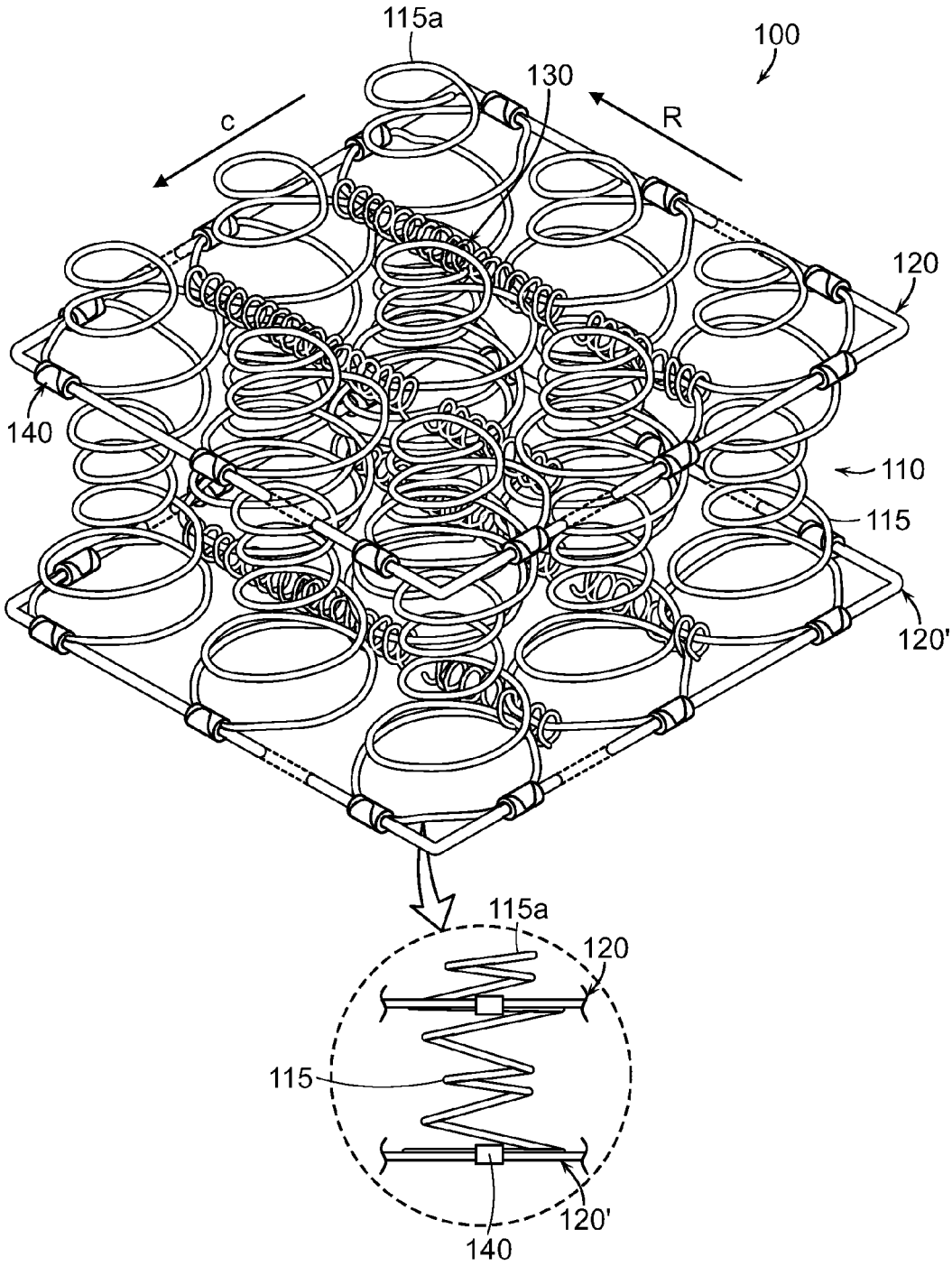
FIG. 1 is a perspective view illustrating a conventional spring assembly according to an embodiment of the prior art.

Reference will now be made in detail to the preferred embodiment of the present invention with reference to the attached drawings.

Referring to FIGS. 1 to 10, there is shown an apparatus for enclosing exposure wire parts 115*a* of coil springs 115 in a spring assembly 100 for a bed mattress. In the apparatus, the exposure wire parts 115*a* protrude vertically from either an upper edge member 120 or a lower edge member 120' of the spring assembly 100 in such a fashion that at least one of an upper end wire part and a lower end wire part of each of the coil springs 115 protrudes vertically from either the upper edge member 120 or the lower edge member 120'. In this case, the coil springs 115 are arranged spaced apart from one another at regular intervals along row and column directions (R/C) between the upper and lower edge members 120 and 120'.

The apparatus 1 for enclosing exposure wire parts 115*a* of coil springs 115 in a spring assembly 100 for a bed mattress according to the present invention comprises a body 10, a reel unit 20, a traction unit 30, an elevator unit 15, a front insertion unit 40, a side insertion unit 80, an adhesive unit 50, a feeder unit 60, a cutter unit 70, a support unit 90, and a controller C.

The spring assembly 100 is loaded on the body 10 and a vertical prop 12 and a fixing stand 13 are mounted on the body 10 in such a fashion as to be spaced apart from each other by a certain interval. The reel unit 20 is mounted at an upper portion of the vertical prop 12 and is adapted to wind a non-woven fabric therearound. The traction unit 30 pulls and hauls the non-woven fabric wound around the reel unit 20, by a predetermined length upon the operation of a cylinder 31. The elevator unit 15 is disposed between the vertical prop 12 and the fixing stand 13 and is adapted to vertically pull the non-woven fabric 22 by a length sufficient to be inserted into the exposure wire parts 115*a* of the coil springs 115 upon the operation of a cylinder 15*a*. The front insertion unit 40 is mounted at the fixing stand 13 and is adapted to push the non-woven fabric 22 toward the exposure wire parts 115*a* in a transverse direction of the exposure wire parts 115*a* while rotating by means of cylinders 41 and 47. The side insertion unit 80 is mounted at the body 10 and is adapted to push the non-woven fabric 22 toward both sides of the exposure wire parts 115*a* while moving back and forth by means of a cylinder 81. The adhesive unit 50 is mounted at a side portion of the front insertion unit 40 and is adapted to adhesively fix the non-woven fabric inserted into the exposure wire parts 115*a* while ascending and descending by means of a cylinder 51. The feeder unit 60 is mounted on the body 10 and is adapted to horizontally move the spring assembly 100 by one step while moving back and forth by means of a cylinder 61. The cutter unit mounted on the body 10 in such a fashion as to be positioned in a feed path of the spring assembly 100 and is adapted to cut the non-woven fabric 22 while ascending and descending by means of a cylinder 71. The support unit 90 is mounted below the front insertion unit 40 and is adapted to set the height of the exposure wire parts 115*a* while ascending and descending by means of a cylinder 91. And, the controller C is adapted to receive a signal indicating that the spring assembly 100 is loaded on the body to generate an operating signal in response to the received signal for sequential application to the respective cylinders 15*a*, 31, 41, 47, 51, 61, 71, 81 and 91.

In this case, the body 10, the reel unit 20, the traction unit 30, the elevator unit 15, the front insertion unit 40, the side insertion unit 80, the adhesive unit 50, the feeder unit 60, the cutter unit 70 and the support unit 90 constituting the apparatus 1 according to present invention are operated automatically or manually in response to the operating signal output from the controller C.

Figure 2:
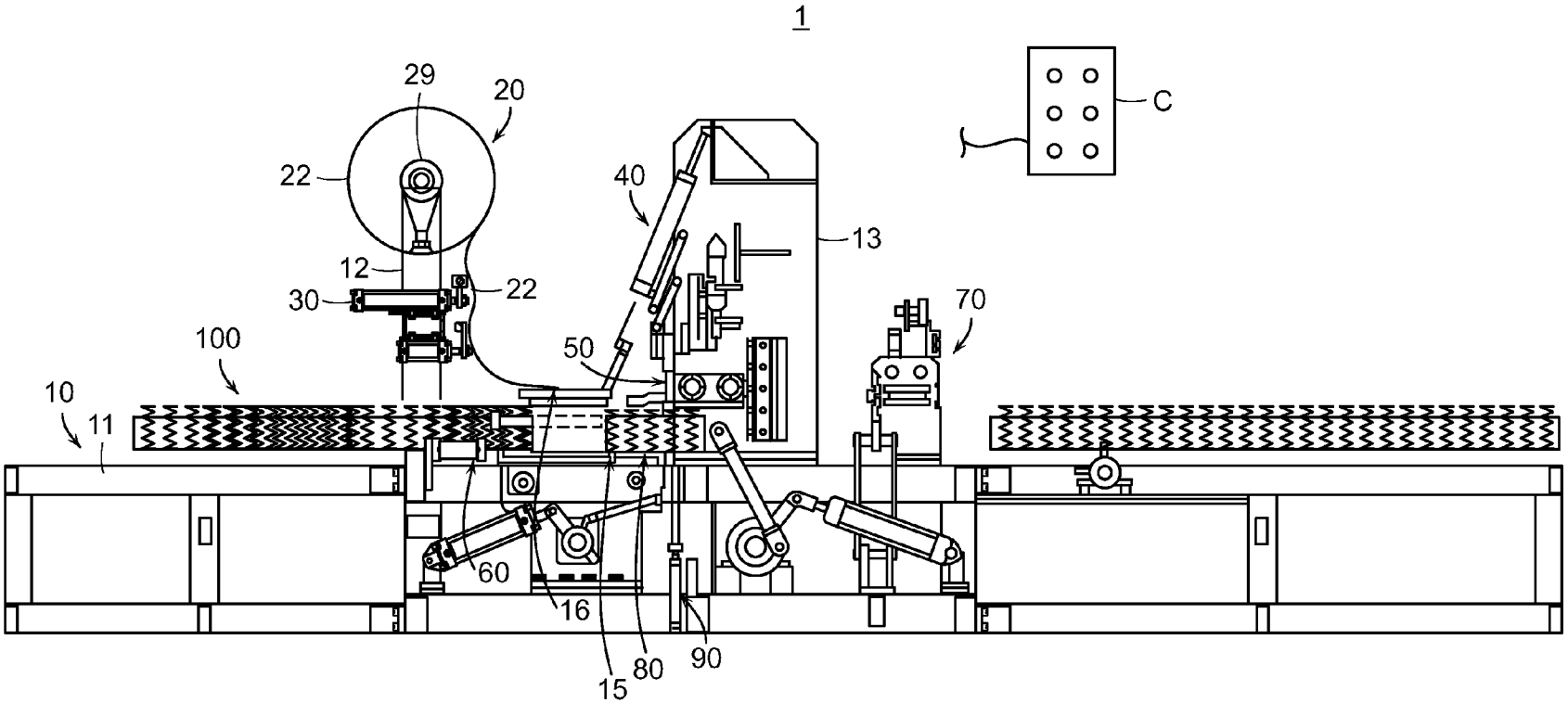
FIG. 2 is a schematic view illustrating an apparatus for enclosing exposure wire parts of coil springs in a spring assembly for a bed mattress according to the present invention.

As shown in FIG. 2, on the body 10 is positioned the spring assembly 100 fed by means of a feed device (not shown). The body 10 includes a planar loading plate 11 on which the spring assembly 100 is loaded, a vertical prop 12 at which the reel unit 20 and the traction unit 30 are mounted respectively, a fixing stand 13 at which the front insertion unit 40, the side insertion unit 80 and the adhesive unit 50 are mounted respectively, and a seating plate 16 disposed between the vertical prop 12 and the fixing stand 13 for allowing the non-woven fabric to be seated thereon.

At this time, the body 11 may be fabricated of any shape on which the spring assembly can be loaded horizontally. Particularly, the body 11 is preferably fabricated of a steel structure possible in terms of strength and endurance.

The reel unit 20, as shown in FIG. 2, is mounted at an upper portion of the vertical prop 12 on the body 10 and supplies a non-woven fabric 22 wound therearound to the exposure wire parts 115*a*. The reel unit 20 is fixed to the vertical prop 12 and the non-woven fabric 22 is wound around a roller 23.

Figure 3:
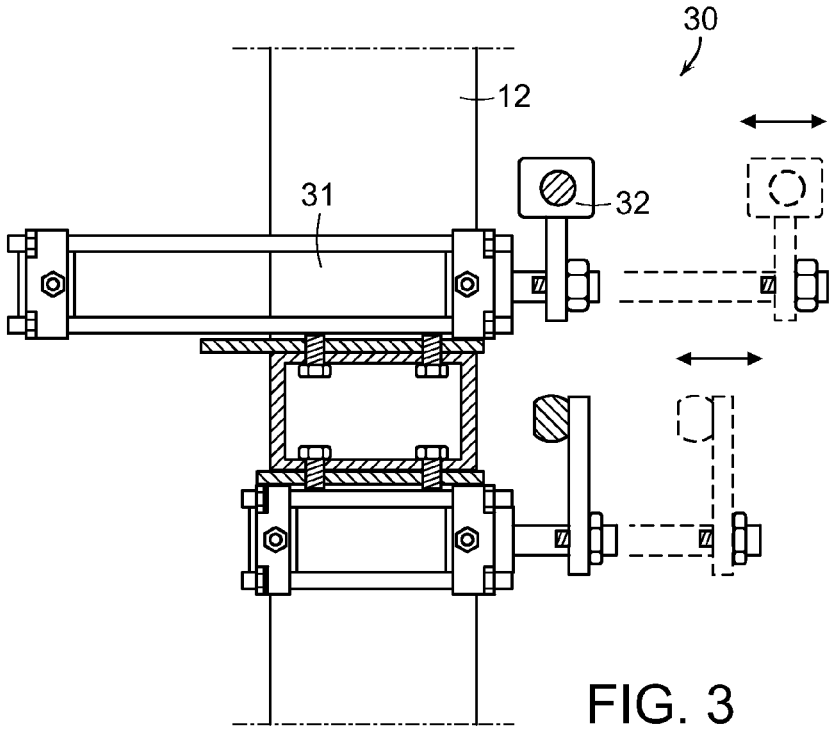
FIG. 3 is a schematic view illustrating a traction unit of an apparatus for enclosing exposure wire parts of coil springs according to the present invention.

The traction unit 30, as shown in FIG. 3, is mounted at a supply line of the reel unit 20, and supplies the non-woven fabric 22 wound around the roller 23 by a predetermined length to the exposure wire parts 115*a*. The traction unit 30 includes a plurality of cylinders 31 fixed horizontally to a side of the vertical prop 12, and retaining members 32 fixed at a front end thereof to rods of the cylinders, respectively, for allowing the non-woven fabric 22 to be alternately retained therein to be hauled by a predetermined length.

Figure 4:
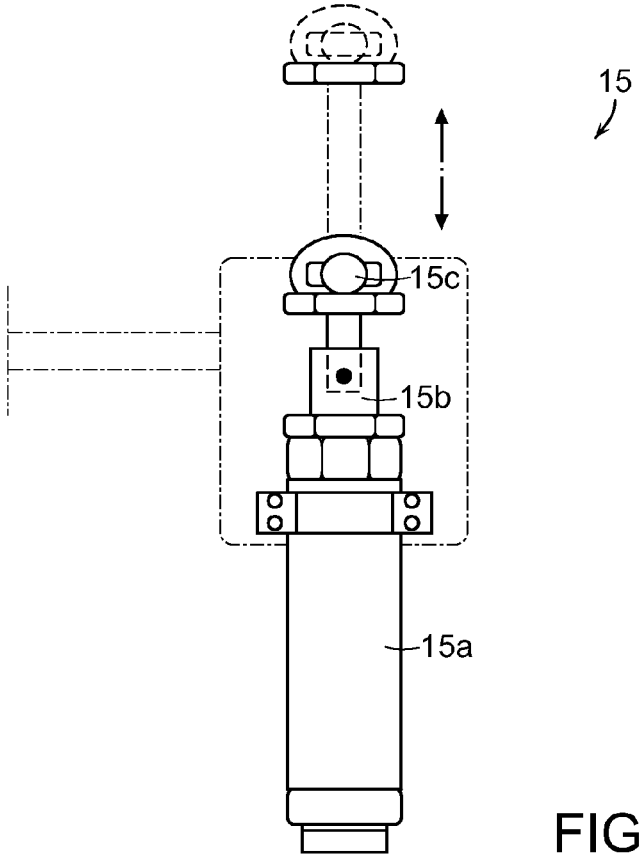
FIG. 4 is a schematic view illustrating an elevator unit of the apparatus for enclosing exposure wire parts of coil springs according to the present invention.

The elevator unit 15, as shown in FIG. 4, is disposed between the vertical prop 12 and the fixing stand 13, and serves to vertically pull the non-woven fabric 22 by a length sufficient to be inserted into the exposure wire parts 115*a* of the coil springs. The elevator unit 15 includes at least one pair of cylinders 15*a* mounted at the body 11, a frame member 15*b* mounted on a rod of each cylinder 15*a* and adapted to ascend and descend by means of the cylinders 15*a*, and a seating member 15*c* mounted on the frame member 15*b* and adapted to allow the non-woven fabric 22 to be seated thereon.

Figure 5:
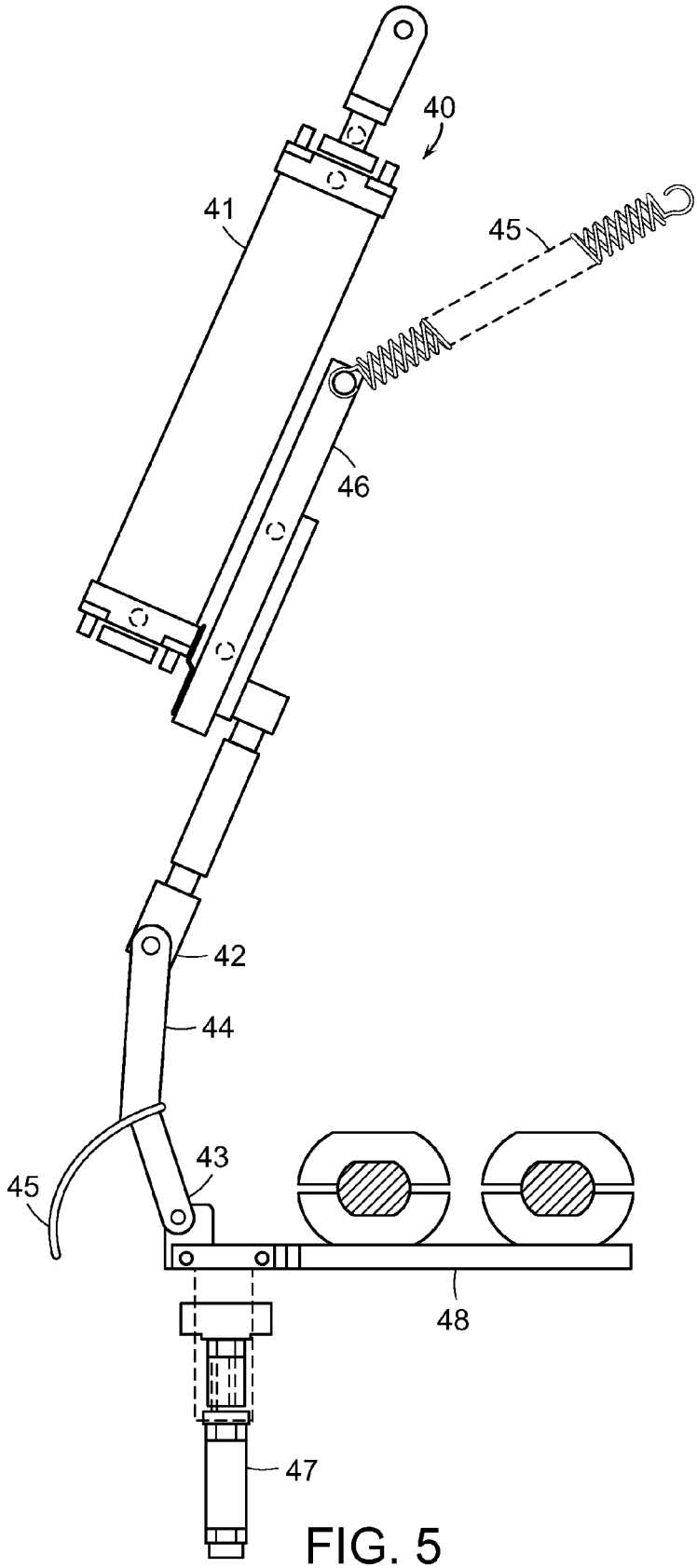
FIG. 5 is a schematic view illustrating a front insertion unit of the apparatus for enclosing exposure wire parts of coil springs according to the present invention.

The front insertion unit 40, as shown in FIG. 5, pushes the non-woven fabric 22 supplied from the traction unit 30 toward a lower portion of the exposure wire parts 115*a*. The front insertion unit 40 includes a slant plate 46 inclinedly mounted to an upper portion of the fixing stand 13 and adapted to reciprocate by means of a cylinder 41 and returning through a return spring 49, an ascending/descending plate 48 mounted at a lower portion of the fixing stand 13 and adapted to ascend and descend by means of a cylinder 47, a rotatable plate 44 fixed to the slant plate 46 and the ascending/descending plate 48, respectively, by means of hinge points 42 and 43, and a round push member 45 mounted at a front side of the rotatable plate 44 and adapted to reciprocate toward a lower portion of the exposure wire parts 115*a*.

At time, the round push member 45 of the front insertion unit 40 is formed in plural numbers. It should be appreciated that the number of round push member 45 preferably corresponds to the number of the coil springs 115 arranged at regular intervals along the column direction (C) between the upper and lower edge members 120 and 120' in the spring assembly 100.

Figure 6:
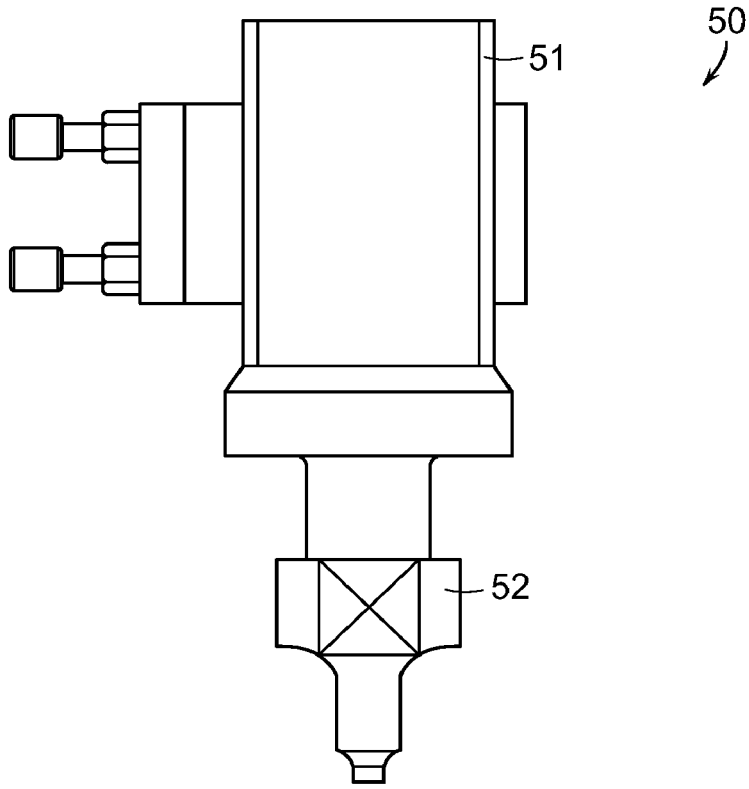
FIG. 6 is a schematic view illustrating an adhesive unit of the apparatus for enclosing exposure wire parts of coil springs according to the present invention.

The adhesive unit 50, as shown in FIG. 6, acts to adhesively fix the non-woven fabric 22 inserted into the exposure wire parts 115*a* by the front insertion unit 40. The adhesive unit 50 includes a cylinder 51 mounted at a side portion of the front insertion unit 40, and an adhesive tip 52 mounted to a lower rod of the cylinder 51 and adapted to supply adhesive means toward the non-woven fabric 22. In this case, a high frequency wave is preferably used as the adhesive means. However, any conventional adhesive means, such as a hot-melt, a bond paper, or the like, can be used as the adhesive means.

Figure 7:
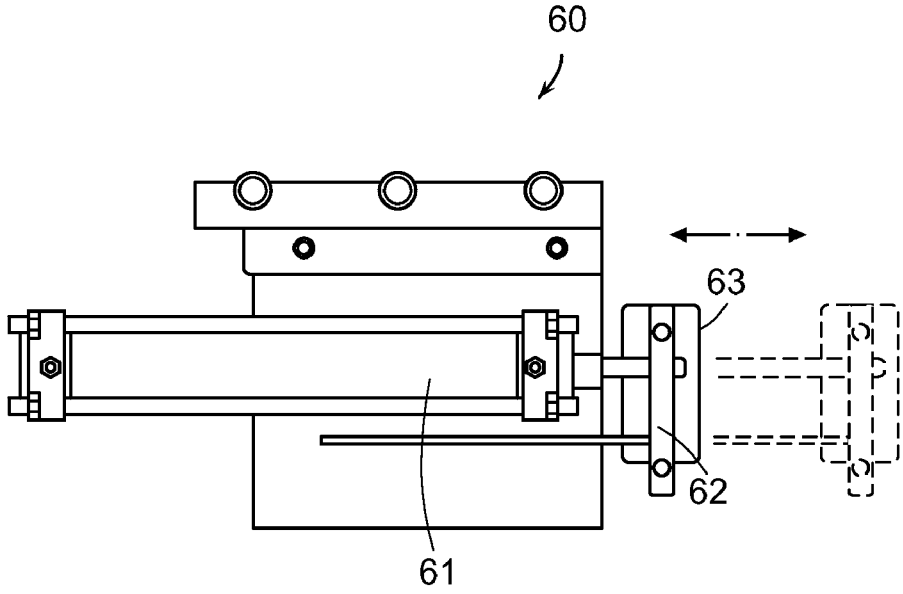
FIG. 7 is a schematic view illustrating a feed unit of the apparatus for enclosing exposure wire parts of coil springs according to the present invention.

The feeder unit 60, as shown in FIG. 7, horizontally moves the spring assembly 100 by one step in the column direction (C) when the enclosing process of the exposure wire parts 115*a* is completed. The feeder unit 60 includes a cylinder 61 mounted longitudinally on the top surface of the planar loading plate 11, a movable member 62 coupled to a rode of the cylinder 61 and adapted to reciprocate by means of the cylinder 61, and a push member 63 mounted to a side of the movable member 62 and adapted to moves the spring assembly 100 by one step by a distance corresponding to an arrangement interval of the coil springs 115.

Figure 8:
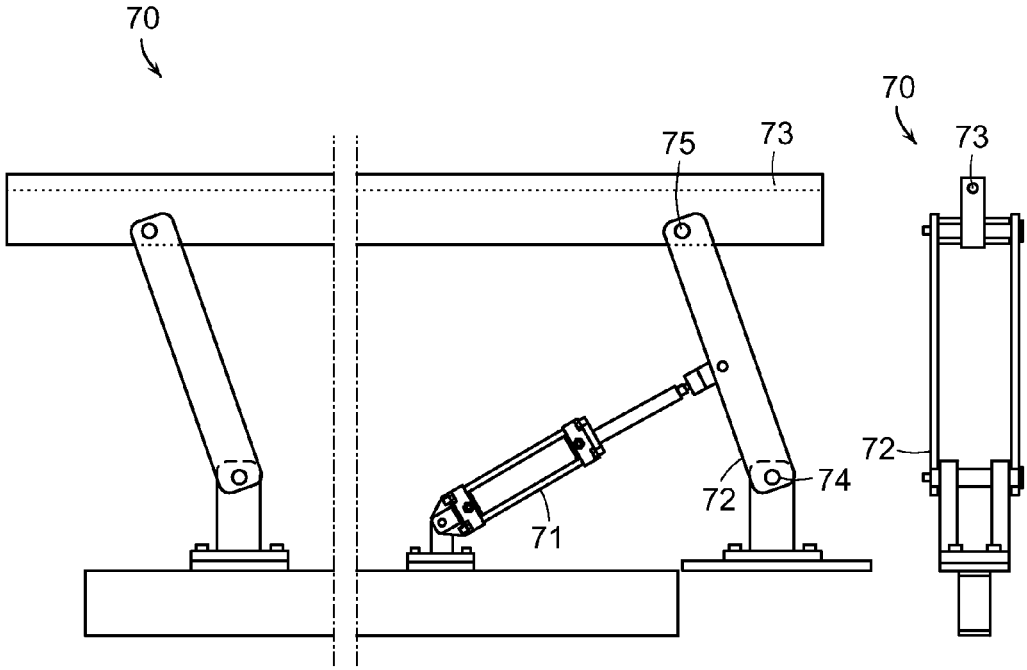
FIG. 8 is a schematic view illustrating a cutter unit of the apparatus for enclosing exposure wire parts of coil springs according to the present invention.

The cutter unit 70, as shown in FIG. 8, cuts the non-woven fabric 22 when the enclosing process of the exposure wire parts 115*a* is completed. The cutter unit 70 includes a cylinder 71 inclinedly mounted to the body 10, a pair of linkage members 72 coupled to a rod of the cylinder 71 and adapted to be folded or extended about a hinge point 74, a hot wire 73 coupled to an upper end portion of the linkage member 72 by means of a hinge point 75 and adapted to cut the non-woven fabric 22 while being in direct contact with the non-woven fabric 22 of the spring assembly passing through the fixing stand 13.

Figure 9:
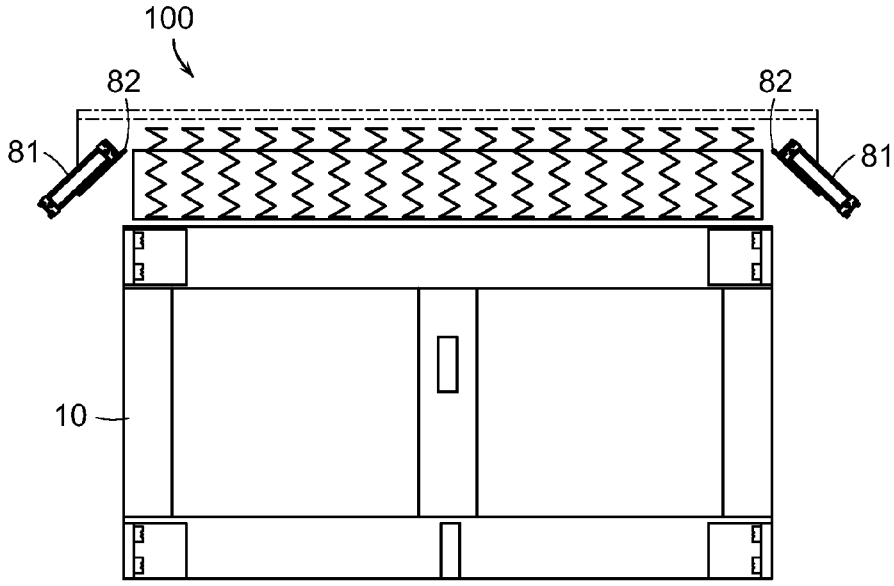
FIG. 9 is a schematic view illustrating a side insertion unit of the apparatus for enclosing exposure wire parts of coil springs according to the present invention.

The side insertion unit 80, as shown in FIG. 9, pushes the non-woven fabric 22 toward both sides of the exposure wire parts 115*a* in the spring assembly 100 seated on the body 10. The side insertion unit 80 includes a cylinder 81 mounted at both sides of the planar loading plate 11, and a push member 82 mounted on a rod of the cylinder 81 and adapted to push both sides of the non-woven fabric 22 to the exposure wire parts 115*a*.

Figure 10:
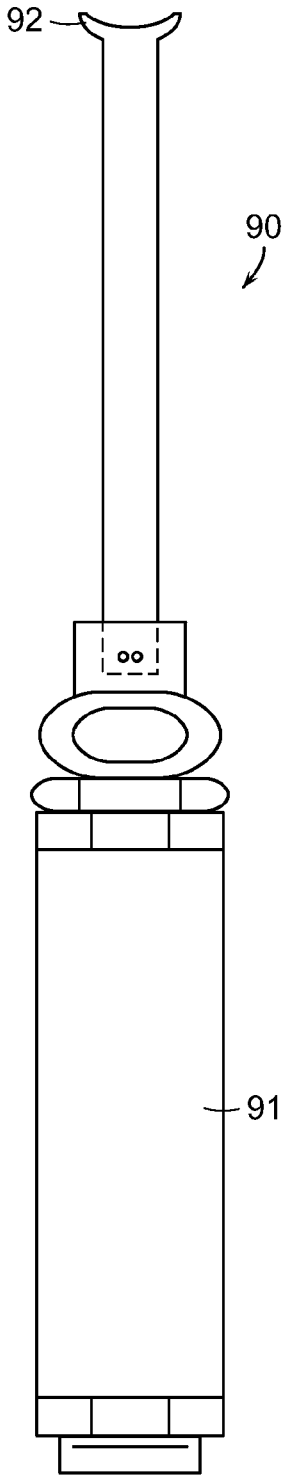
FIG. 10 is a schematic view illustrating a support unit of the apparatus for enclosing exposure wire parts of coil springs according to the present invention.

The support unit 90, as shown in FIG. 10, is vertically disposed at a lower portion of the planar loading plate 11 and is adapted to support a lower portion of the exposure wire parts 115*a* in the spring assembly 100. The support unit 90 includes a cylinder 91 mounted vertically at a lower portion of the loading plate 11, and a support ring 92 mounted at an upper end of a rod of the cylinder 91 and adapted to come into close contact with the lowermost wire parts of the exposure wire parts 115*a*.

The controller C electronically controls the overall operation of the apparatus 1 so as to automatically perform a series of enclosing works. The controller C receives a signal indicating that the spring assembly 100 fed to the body 10 is loaded on the body to generate an operating signal in response to the received signal for sequential application to the cylinders 15*a*, 31, 41, 51, 61, 71, 81 and 91.

Now, the operation of the apparatus 1 according to the present invention will be described in detail hereinafter.

First, when an operation switch of the apparatus 1 is turned "ON", the exposure wire parts 115*a* of the spring assembly 100 fed by means of a feed device (not shown) are transferred to a setting position of the body 10 while orienting the exposure wire parts faced upward.

Subsequently, the traction unit 30 receives the operating signal from the controller C to allow the cylinder 31 of the traction unit to be operated so that it pulls and hauls the non-woven fabric 22 retained alternately in the retaining member 32 thereof by a certain length so as to be seated on the seating plate 16.

At this time, the non-woven fabric 22 wound around the reel unit is released by a certain length from during the operation of the traction unit 30 and pulled alternately during the back and forth movement of the retaining member 32 so that the non-woven fabric 22 is maintained at a relatively tight state.

Next, the front insertion unit 40 receives the operating signal from the controller C to allow the cylinder 41 thereof to be operated so that the slant plate 46 is downwardly moved slantly and accordingly the rotatable plate 44 hingeably coupled to the slant plate 46 rotates in a counter-clockwise direction.

As a result, referring to FIG. 5 the round push member 45 mounted at a side of the rotatable plate 44 rotates in a counter-clockwise direction about the hinge points 42 and 43, so that the non-woven fabric 22 is pushed by the round push member so as to be inserted into the exposure wire parts 115.

In other words, the rotatable plate 44 hingeably coupled to the slant plate 46 of the front insertion unit 40 rotates in a counter-clockwise direction about the hinge point 42, so that the round push member 45 mounted at the rotatable plate 44 is oriented toward the lower portion of the exposure wire parts 115 and then the non-woven fabric 22 is pushed into the exposure wire parts 115.

At the same time, the side insertion unit 80 receives the operating signal from the controller C to allow the cylinder 81 thereof to be operated so that the push member 82 of the side insertion unit pushes the non-woven fabric 22 formed at both sides of the spring assembly 100 into the exposure wire parts 115.

At this time, the exposure wire parts 115*a* of the spring assembly 100 is supported by the support ring 92 of the support unit 90 so as to maintain the setting height of the exposure wire parts 115*a*.

Then, the adhesive unit 50 receives the operating signal from the controller C to allow the cylinder 51 thereof to be operated so that a high-frequency wave output from the adhesive tip 52 adhesively fixes the exposure wire parts 115*a* with the non-woven fabric 22 inserted into the exposure wire parts 115*a* to thereby enclose the exposure wire parts 115*a*.

Next, the front insertion unit 40 allows the cylinder 41 thereof to be operated in response to the operating signal from the controller C so that the slant plate 46 rotates in a clockwise direction in FIG. 5 and then the round push member 45 is retracted from the exposure wire parts 15*a*.

Then, the round push member 45 ascends by means of the cylinder 47 of the front insertion unit 40 to define a space with a certain distance.

Thereafter, the elevator unit 15 receives the operating signal from the controller C to allow the cylinder 15*a* of the elevator to be operated so that since the frame member 15*b* ascends to cause the non-woven fabric 22 to be upwardly moved, non-woven fabric 22 is vertically pulled by a length sufficient to be inserted into the exposure wire parts 115*a*.

Subsequently, the feeder unit 60 receives the operating signal from the controller C to allow the cylinder 61 of the feeder unit to be operated so that the movable member 62 moves the spring assembly 100 by one step in the column direction (C) by a distance corresponding to an arrangement interval of the coil springs 115 while advancing.

In this manner, the exposure wire parts 115*a*, positioned in one line along the column direction C among the exposure parts 115*a* formed in the spring assembly 100, are enclosed. When the above steps are repeatedly performed, the enclosing work of the exposure wire parts 115*a* is consecutively carried out on a "one-line" basis among the exposure parts 115*a*.

In the meanwhile, when the enclosing work of the exposure wire parts 115*a* along the column direction C in the spring assembly is completed, the cutter unit 70 receives the operating signal from the controller C to allow the cylinder 71 of the cutter unit to be operated so that the non-woven fabric 22 is cut by means of heat generated from the hot wire 73.

In this manner, a series of processes according to the enclosure of the exposure wire parts 115a formed in the spring assembly 100 is accomplished.

As apparent from the foregoing, according to the inventive apparatus for enclosing exposure wire parts 115*a* of coil springs 115 in a spring assembly 100 for a bed mattress, the enclosing work of the exposure wire parts protrudingly formed in the spring assembly is performed automatically so that various work loads and the number of work processes according to the enclosing work can be minimized to thereby maximize the work productivity as well as the relevant cost according to the enclosing work is reduced, thereby saving the production cost of the mattress and improving the product competitiveness of the mattress.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An apparatus for enclosing exposure wire parts of coil springs in a spring assembly for a bed mattress, the exposure wire parts protruding vertically from either an upper edge member or a lower edge member of the spring assembly, wherein the coil springs are arranged spaced apart from one another at regular intervals along row and column directions (R/C) between the upper and lower edge members in the spring assembly, the apparatus comprising:

a body on which the spring assembly is loaded and a vertical prop and a fixing stand are mounted in such a fashion as to be spaced apart from each other by a certain interval;

a reel unit mounted at an upper portion of the vertical prop for winding a non-woven fabric therearound;

a traction unit for pulling and hauling the non-woven fabric wound around the reel unit, by a predetermined length upon the operation of a cylinder;

an elevator unit disposed between the vertical prop and the fixing stand for vertically pulling the non-woven fabric by a length sufficient to be inserted into the exposure wire parts of the coil springs upon the operation of a cylinder;

a front insertion unit mounted at the fixing stand for pushing the non-woven fabric toward the exposure wire parts in a transverse direction of the exposure wire parts while rotating by means of cylinders;

a side insertion unit mounted at the body for pushing the non-woven fabric toward both sides of the exposure wire parts while moving back and forth by means of a cylinder;

an adhesive unit mounted at a side portion of the front insertion unit for fixing the non-woven fabric inserted into the exposure wire parts while ascending and descending by means of a cylinder;

a feeder unit mounted on the body for horizontally moving the spring assembly by one step while moving back and forth by means of a cylinder;

a cutter unit mounted on the body in such a fashion as to be positioned in a feed path of the spring assembly for cutting the non-woven fabric while ascending and descending by means of a cylinder;

a support unit mounted below the front insertion unit for setting the height of the exposure wire parts while ascending and descending by means of a cylinder; and a controller C for receiving a signal indicating that the spring assembly is loaded on the body to generate an operating signal in response to the received signal for sequential application to the respective cylinders.

2. The apparatus as set forth in claim 1, wherein the elevator unit includes at least one pair of cylinders mounted at the body, a frame member mounted on a rod of each cylinder and adapted to ascend and descend by means of the cylinders, and a seating member mounted on the frame member and adapted to allow the non-woven fabric to be seated thereon.

3. The apparatus set forth in claim 1, wherein the traction unit includes retaining members fixed at front ends thereof to rods of the cylinders, respectively, for allowing the non-woven fabric to be alternately retained therein to be hauled by a predetermined length.

4. The apparatus as set forth in claim 1, wherein the front insertion unit includes a slant plate inclinedly mounted to an upper portion of the fixing stand and adapted to reciprocate by means of a cylinder, an ascending/descending plate mounted at a lower portion of the fixing stand and adapted to ascend and descend by means of a cylinder, a rotatable plate fixed to the slant plate and the ascending/descending plate, respectively, by means of hinge points, a round push member mounted at a front side of the rotatable plate and adapted to reciprocate toward a lower portion of the exposure wire parts, and a return spring mounted at a side of the fixing stand and adapted to return the slant plate.

5. The apparatus as set forth in claim 1, wherein the adhesive unit uses a high frequency wave as an adhesive means.

6. The apparatus as set forth in claim 1, wherein the feeder unit includes a movable member coupled to a rod of the cylinder and adapted to reciprocate by means of the cylinder, and a push member mounted to a side of the movable member and adapted to moves the spring assembly by one step.

7. The apparatus as set forth in claim 1, wherein the cutter unit includes a hot wire formed at a front end thereof so as to cut the non-woven fabric while being in direct contact with the non-woven fabric horizontally.

8. The apparatus as set forth in claim 1, wherein the support unit includes a support ring mounted at an upper end thereof and adapted to come into close contact with the lowermost wire parts of the exposure wire parts.

* * * * *